US007411600B2

(12) United States Patent
Schuh

(10) Patent No.: US 7,411,600 B2
(45) Date of Patent: Aug. 12, 2008

(54) THERMAL PRINTING DEVICE, METHOD FOR PRINTING AN IMAGE USING SAID PRINTING DEVICE AND SYSTEM FOR PRINTING AN IMAGE

(75) Inventor: Dana F. Schuh, Windham, NH (US)

(73) Assignee: Polaroid Corporation, Concord, MA (US)

( * ) Notice: Subject to any disclaimer, the term of this patent is extended or adjusted under 35 U.S.C. 154(b) by 443 days.

(21) Appl. No.: 11/274,029

(22) Filed: Nov. 15, 2005

(65) Prior Publication Data

US 2006/0103710 A1 May 18, 2006

Related U.S. Application Data

(60) Provisional application No. 60/627,909, filed on Nov. 16, 2004.

(51) Int. Cl.
*B41J 2/32* (2006.01)
*B41J 3/60* (2006.01)

(52) U.S. Cl. ..... 347/172

(58) Field of Classification Search ..... 347/171, 347/172, 174, 176, 104; 400/188, 120.01, 400/120.02

See application file for complete search history.

(56) References Cited

U.S. PATENT DOCUMENTS

| | | | | |
|---|---|---|---|---|
| 4,811,036 | A | 3/1989 | Gaskill et al. | 346/76 PH |
| 4,857,941 | A | 8/1989 | Kaida | 346/76 PH |
| 4,932,798 | A | 6/1990 | Kardinal et al. | 400/120 |
| 4,940,993 | A | 7/1990 | Sato | 346/76 PH |
| 4,956,251 | A | 9/1990 | Washizu et al. | 430/138 |
| 4,962,386 | A | 10/1990 | Hakkaku et al. | 346/1.1 |
| 5,095,316 | A | 3/1992 | Hakkaku | 346/1.1 |
| 5,101,222 | A | 3/1992 | Hakkaku | 346/76 PH |
| 5,284,816 | A | 2/1994 | Stephenson | 503/227 |
| 5,486,057 | A | 1/1996 | Skinner et al. | 400/120.02 |
| 5,550,572 | A | 8/1996 | Chang et al. | 347/171 |
| 5,558,449 | A | 9/1996 | Morgavi | 400/188 |
| 5,600,362 | A | 2/1997 | Morgavi et al. | 347/218 |
| 5,675,369 | A | 10/1997 | Gaskill | 347/171 |
| 5,677,722 | A | 10/1997 | Park | 347/218 |
| 5,973,711 | A | 10/1999 | Schartner et al. | 347/173 |
| 6,046,756 | A | 4/2000 | Iga et al. | 347/173 |
| 6,296,405 | B1 | 10/2001 | Brewington et al. | 400/188 |
| 6,601,952 | B2 | 8/2003 | Sugioka et al. | 347/104 |
| 6,801,233 | B2 | 10/2004 | Bhatt et al. | 347/175 |

(Continued)

FOREIGN PATENT DOCUMENTS

| | | |
|---|---|---|
| DE | 40 34 327 A1 | 4/1992 |

(Continued)

*Primary Examiner*—Huan H Tran

(57) ABSTRACT

A printing device that includes a platen for supporting an imaging member during a printing operation and at least one print head subassembly for direct thermal printing on the imaging member. The print head subassembly can be configured to be movable independently of the platen for printing on a first surface of the imaging member in a first transport path and on a second surface of the imaging member in a second transport path. Alternatively, the printing device can include two print head subassemblies, each positioned to print on a different side of the imaging member. The position of the print line of the print head in each printing position is offset from a dead center alignment with respect to a platen.

10 Claims, 7 Drawing Sheets

U.S. PATENT DOCUMENTS

| | | | | |
|---|---|---|---|---|
| 7,198,419 | B2 * | 4/2007 | Lee | 400/120.16 |
| 2001/0021331 | A1 | 9/2001 | Brewington et al. | 400/188 |
| 2002/0001027 | A1 | 1/2002 | Sugioka et al. | 347/104 |

FOREIGN PATENT DOCUMENTS

| | | | |
|---|---|---|---|
| EP | 0 785 079 | B1 | 6/2000 |
| EP | 1 291 193 | A1 | 3/2003 |
| JP | 59-020688 | | 2/1984 |
| JP | 05-131702 | | 5/1993 |

* cited by examiner

THERMAL PRINTING DEVICE, METHOD FOR PRINTING AN IMAGE USING SAID PRINTING DEVICE AND SYSTEM FOR PRINTING AN IMAGE

REFERENCE TO RELATED APPLICATION

This application claims the benefit of provisional application Ser. No. 60/627,909, filed Nov. 16, 2004.

BACKGROUND OF THE INVENTION

1. Field of the Invention

The present invention relates generally to thermal printing devices. More specifically, the present invention relates to a thermal printing device, a method for printing a multicolored image using the printing device and a system for printing multicolored images.

2. Description of Related Art

Various conventional printing devices include a printing head that is capable of transferring a colorant to a substrate. Several different techniques may be used for the transfer of colorant, including ink jet, electrostatic toner transfer, and thermal transfer. Printing devices using these techniques can print a single, or more than one color, and may print onto individual or continuous sheets that may be opaque or transparent.

Users of printing devices typically demand printing of photographic quality so that they can, for example, print digital images captured from digital cameras. The desire for photographic quality, full-color images has forced conventional, colorant-transfer printing technologies to evolve to their limits. Such technologies have, in some cases, proved to be less than satisfactory for photographic printing.

Direct thermal printing provides an entirely different method for forming images on an imaging material, which may be in the form of an individual sheet of a specific size, e.g., 4×6 inches or a continuous sheet. Typically, the imaging material includes a substrate, or carrier, and a plurality of color-forming layers can be arranged on one side of the substrate or one or more color-forming layers can be arranged on each side of the substrate. A direct thermal printing device includes no ink, toner, or transfer ribbon, but simply a printing head for heating the imaging sheet itself. The imaging material for use in direct thermal printing contains at least one dye or dye precursor that changes color when heated. Examples of direct thermal printing systems are disclosed in, for example, U.S. Pat. No. 6,801,233 B2 assigned to the assignee of the instant application.

Imaging materials for direct thermal printing devices that are intended to produce multicolored images may be transparent, and may include at least one color-forming layer on each surface. Each color-forming layer on one side of the substrate forms an image in at least one color, while each color-forming layer on the other side of the substrate forms an image in at least another color. Images are formed by heating each side of the imaging material with a thermal head or other heating device, which can apply heat in an imagewise pattern. The images formed on each side of the transparent substrate are viewed together from one side of the imaging material to present to the viewer a composite, multicolored image. In conventional printing onto an opaque imaging sheet, on the other hand, there is no need for the images on each side of the sheet to be the same size as each other, or in registration.

Several methods for printing on both surfaces of a direct thermal imaging material have been proposed. For example, U.S. Pat. No. 4,962,386 discloses a printing device with an extremely complex mechanism for rotating the substrate such that both surfaces can be exposed to a print head sequentially. In U.S. Pat. No. 6,601,952 a method is disclosed for rotating an entire recording unit to print on the second surface of an imaging material. Another method for imaging both surfaces of a direct thermal imaging material employs two print heads, one of which heats one side of the imaging material, while the other heats the opposite side. Each of these prior art methods for printing involves complex arrangements that may be high in cost or difficult to maintain.

Accordingly, there is a need for a thermal printer with a simplified construction that can overcome the deficiencies of the prior art printers.

BRIEF SUMMARY OF THE INVENTION

It is an object of the present invention to provide a novel thermal printing device.

Another object of the invention is to provide a thermal printing device that is capable of heating opposed sides of a thermal imaging material, or member, successively in each of two separate printing passes.

Still another object of the invention is to provide such a thermal printing device which includes one or more print head subassemblies.

Still another object is to provide a thermal printing device which includes a plurality of thermal print heads positioned to print on opposite sides of an imaging member.

Yet another object is to provide a thermal printing device that is capable of heating opposite sides of a thermal imaging material, or member, successively in each of two separate printing passes, by independently moving a print head subassembly of the printer relative to a platen.

Another object is to provide a print head subassembly within a thermal printing device that is configured to rotate about a platen such that heating of both sides of an imaging member can be performed.

A further object is to provide a thermal printing device wherein printing on opposite sides of an imaging member is carried out about an axis that is parallel to, but offset from, the axis of the platen.

Yet another object is provide a print head subassembly within a thermal printing device that rotates the print line of the print head about an axis that is parallel to, but offset from, the axis of the platen.

Still another object is to provide a print head subassembly within a thermal printing device that rotates a line on the print head that is parallel to, but offset from, the print line of the print head about an axis that is parallel to, but offset from, the axis of the platen.

Yet another object is to provide a novel direct thermal printing method for heating opposed sides of an imaging material with at least one print head subassembly.

Another object is to provide a direct thermal printing method for heating opposed sides of an imaging member with a print head subassembly that is configured to rotate about a platen from a first position to a second position, having a transport path for the imaging material that is substantially straight through a driving nip, the first and second positions of the print line of the print head being offset from any plane that includes the platen axis and a line of contact between the platen and the imaging material.

BRIEF DESCRIPTION OF THE DRAWINGS

Additional objects, features, and advantages of the present invention will become apparent from the following detailed description of the preferred embodiments of the invention in conjunction with the accompanying drawings where like reference numerals indicate like features, in which.

DETAILED DESCRIPTION OF PREFERRED EMBODIMENTS

Figure 1:
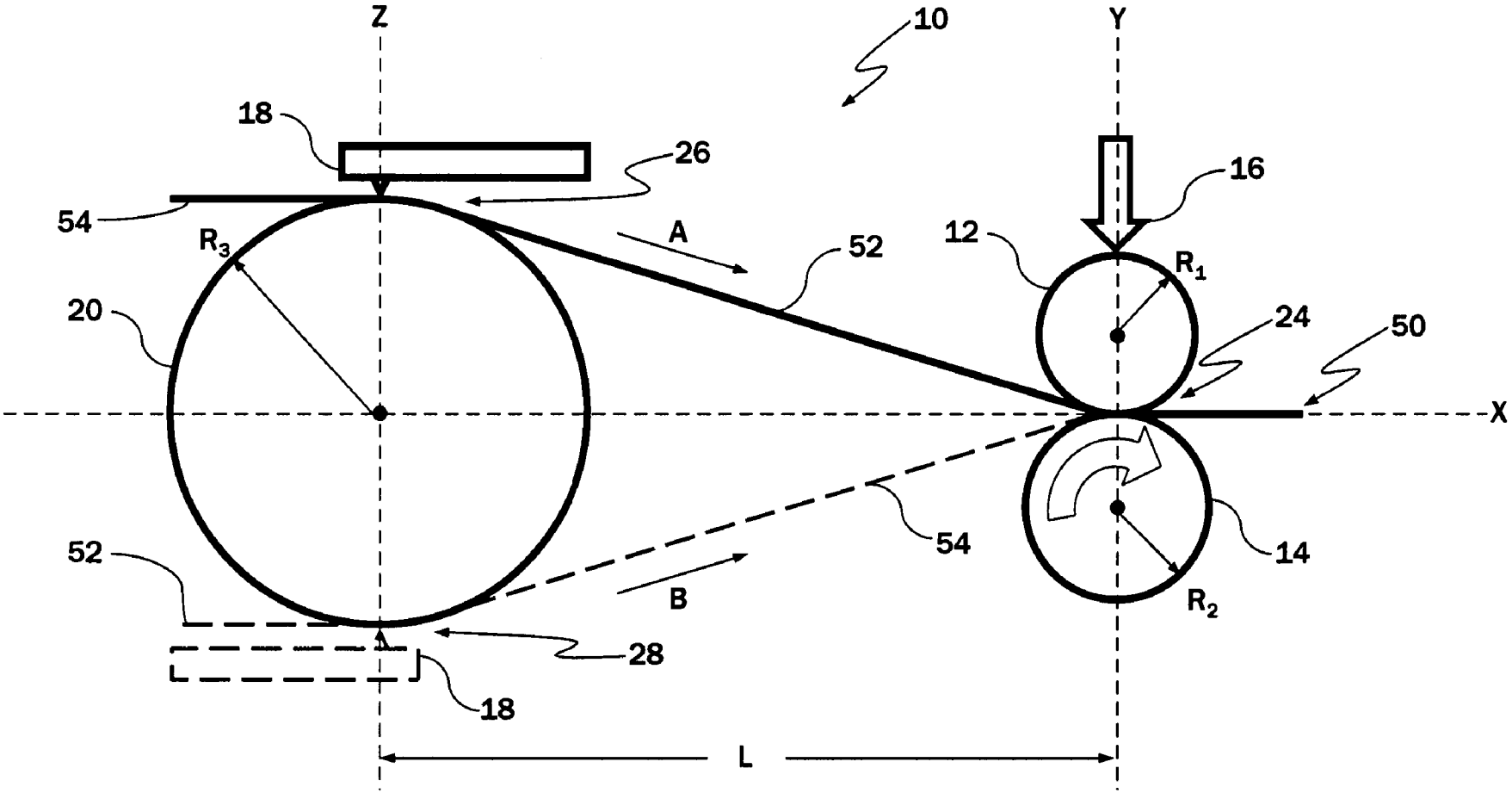
FIG. 1 is a schematic diagram of a thermal printing device with a rotating print head subassembly.

FIG. 1 is a schematic diagram of a thermal printing device 10 with a rotating print head subassembly 18. The thermal printing device 10 includes a first roller 12 and a second roller 14 for driving an imaging member 50 though the thermal printing device 10. Together, roller 12 and roller 14 form a driving nip 24. At least one of the first roller 12 and second roller 14 is rotationally driven to move the imaging member 50 through the driving nip 24, The rotationally driven roller is also referred to hereinafter as the driving roller. In the embodiment shown in FIG. 1, the driving roller is roller 14 and roller 12 is a pressure roller biased by an optional spring 16 for ensuring that the imaging member 50 is generally in contact with both the pressure roller 12 and the driving roller 14.

Although the pressure roller 12 and the driving roller 14 are shown as single rollers, it should be understood that there may be advantages to providing a plurality of pressure and/or driving rollers instead of a single pressure roller or driving roller. Additionally, in some embodiments, the pressure roller 12 and driving roller 14 may extend from one edge of the imaging member 50 to the other, although this is not required. For example, in one embodiment, the driving roller 14 could be a single roller that extends across the imaging member 50 and the pressure roller 12 could be a plurality of rollers on a single shaft which would create a plurality of driving nips 24. In other, more general embodiments, the rollers described above may be any suitable device for driving the imaging member. In such a case, any drive or pressure elements may be used including rollers, belts, and the like.

The imaging sheet 50 may be any type of thermal imaging material. In the embodiment shown in FIG. 1, the imaging member includes a transparent substrate carrying at least one color-forming layer on a top surface 52 and at least one color-forming layer on a bottom surface 54 of the member. Further, it may be preferred in some embodiments to have two color-forming layers on one of the surfaces of the imaging member 50 such that a full color image may be obtained. Specifically, for the purpose of discussion, imaging member 50 may have yellow and magenta color-forming layers on surface 52 and a cyan color-forming layer on surface 54 of a transparent substrate. In this manner, it is possible to create, on imaging member 50, a full color image.

The printing device 10 also includes a platen 20 for supporting the imaging member 50 while a print head subassembly 18 is engaging the imaging member 50. The print head subassembly 18 includes a print head and may, in some embodiments, also include additional elements necessary for printing on imaging materials. For example, the print head subassembly 18 may also include a controller, a heat dissipation device, etc. As shown in FIG. 1, the imaging member 50 may take one of two paths, either path A or path B. Specifically, the imaging member 50 may initially take path A and means, such as an additional roller or deflector, may be provided for guiding the member 50 in the direction indicated by A. Once the member 50 is engaged by the nip 26 formed by the platen 20 and the print head subassembly 18 located in the first, or upper, position, the print head subassembly 18, based on received information, can process the yellow and magenta color-forming layers located on surface 52 of the member, preferably in a single pass. Once that is complete, the print head subassembly 18 is rotated to a second position, shown under the platen 20, in FIG. 1. The imaging member 50 is then guided via path B through a nip 28 formed by the platen 20 and the print head subassembly 18 at the bottom of the platen 20. As can be seen from FIG. 1, when the imaging member 50 is in this position, the print head subassembly 18 can now process surface 54 of the imaging member 50 that contains the cyan color-forming layer.

In the embodiment shown in FIG. 1, the imaging sheet 50 is guided past the pressure roller 12 and driving roller 14 in the direction shown by arrows A and B (i.e., it is pulled away from the nips 26, 28) during the printing operation. However, as would be understood by a person skilled in the art, the imaging member can also be transported by means other than pulling without deviating from the principles of the present invention.

As seen in FIG. 1, a rotational axis of the platen 20 is aligned with the driving nip 24 formed by pressure roller 12 and driving roller 14 (indicated by X) to produce a symmetric geometry between the first path A and the second path B. Additionally, as shown in FIG. 1 (and also in subsequent FIGS.) a substantially vertical axis Z that passes through the rotational axis of the platen, and a substantially vertical axis Y that passes through the rotational axes of the pressure roller 12 and driving roller 14 are both substantially perpendicular to axis X. Such symmetry may be beneficial in particular embodiments of the present invention, but is not required and is illustrated for the purpose of discussion.

In the embodiment of FIG. 1, since only the print head subassembly 18 is moved around the platen 20 to one of the two positions, as shown, the number of moving parts is decreased from, for example, rotating both the print head subassembly 18 and platen 20 as is done in some other conventional printing devices. Additionally, since the imaging member does not have to be inverted during the imaging process and a print head on either side is not required, the complexity of the printing device is decreased as compared to some conventional printing devices. As would be understood by a person of ordinary skill in the art, the thermal printing arrangement 10 shown in FIG. 1 can be used to make a compact device.

In some embodiments, the print head subassembly 18 may be rotated by 180 degrees and in general, the rotation of the print head subassembly 18 is greater than 90 degrees. Even more generally, the print head subassembly 18 is moved from a first to a second position.

Figure 2:
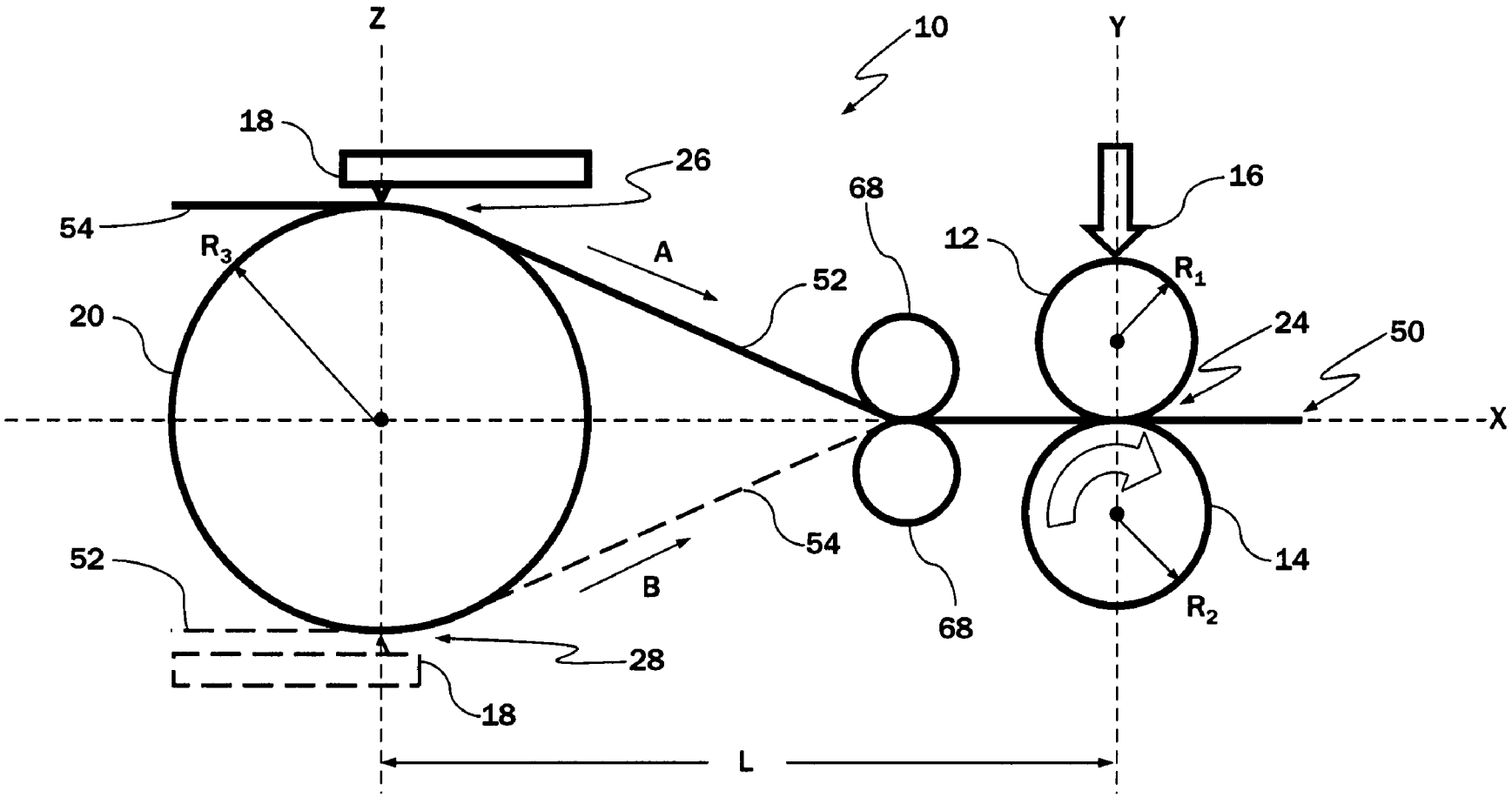
FIG. 2 is a schematic diagram of a configuration of a thermal printing device with a substantially straight path for the imaging material through the driving nip.

FIG. 2 is a schematic diagram of a thermal printing device 10 with a substantially straight path for the imaging member through driving nip 24. The printing device 10 in FIG. 2 is substantially similar to the printing device 10 described in FIG. 1. However, in FIG. 2, a guiding mechanism, in this embodiment a pair of guide rollers 68, is added in the path between the platen 20 and driving nip 24. The guide rollers 68 guide the imaging member 50 into a path that is substantially perpendicular to the plane passing through the axes of the driving roller and pressure roller, such that the imaging member 50 travels through the driving nip 24 in a substantially straight path. As would be understood by a person skilled in the art, any device can be placed in the path of the imaging member 50 to alter the path of the imaging member 50 such that the imaging member 50 can travel through the driving nip 24 in a substantially straight path, thereby substantially eliminating the variations in transport distance of the imaging member with respect to driving roller rotation.

Figure 3:
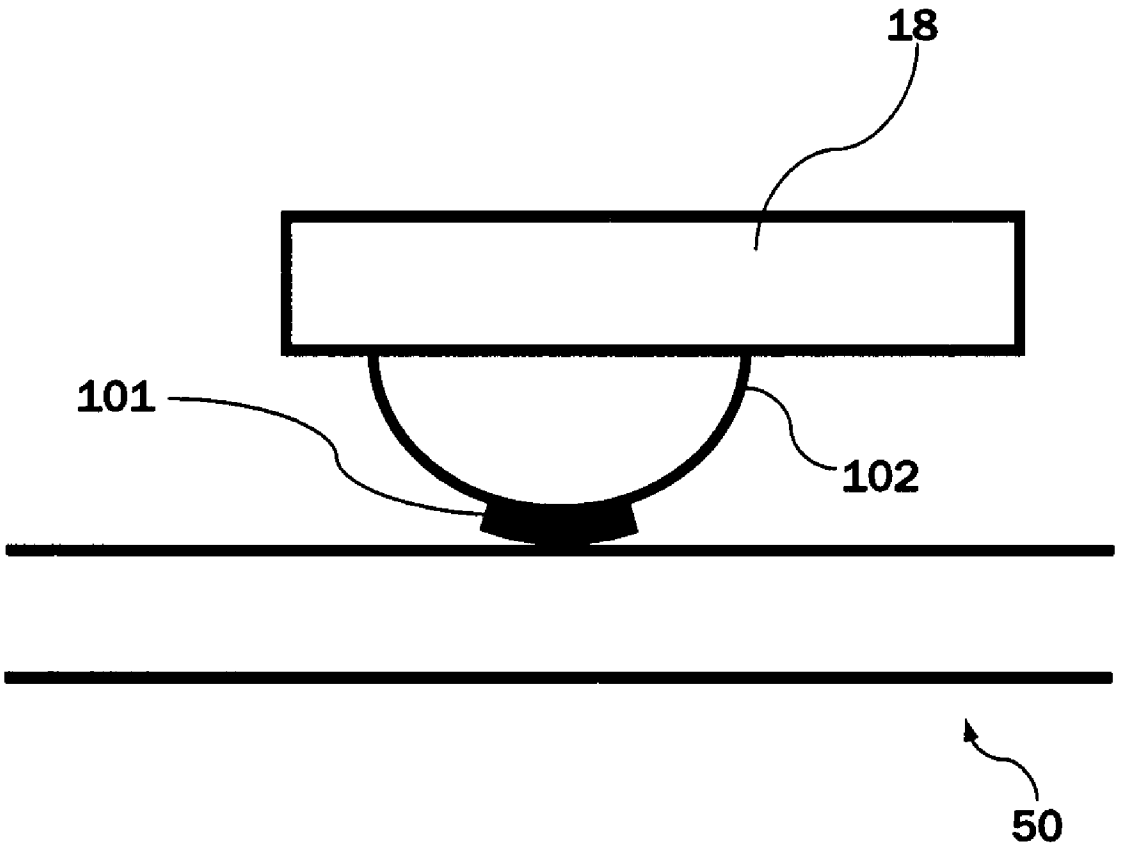
FIG. 3 is a schematic diagram of a print head.

FIG. 3 is a magnified cross-sectional view through a typical thermal print head subassembly 18. The print head comprises a line of heating elements 101, one of which is shown, that extends perpendicular to the plane of the drawing. This line of heating elements is hereinafter referred to as the print line. The heating elements that make up the print line lie substantially, but not necessarily exactly, along a straight line. Each heating element is independently electrically addressable and makes contact with the surface of the imaging member 50. Passage of electrical current through the heating elements generates heat, which is transferred through thermal conduction into the imaging member 50. Effective thermal conduction takes place when the heating elements are in good contact with the surface of the imaging member 50. In a typical thermal print head, the print line is disposed on a raised glaze 102 and the glaze 102 can be curved. The actual dimensions and shape of the glaze vary from print head to print head, as does the location of the print line with respect to the glaze.

Figure 4:
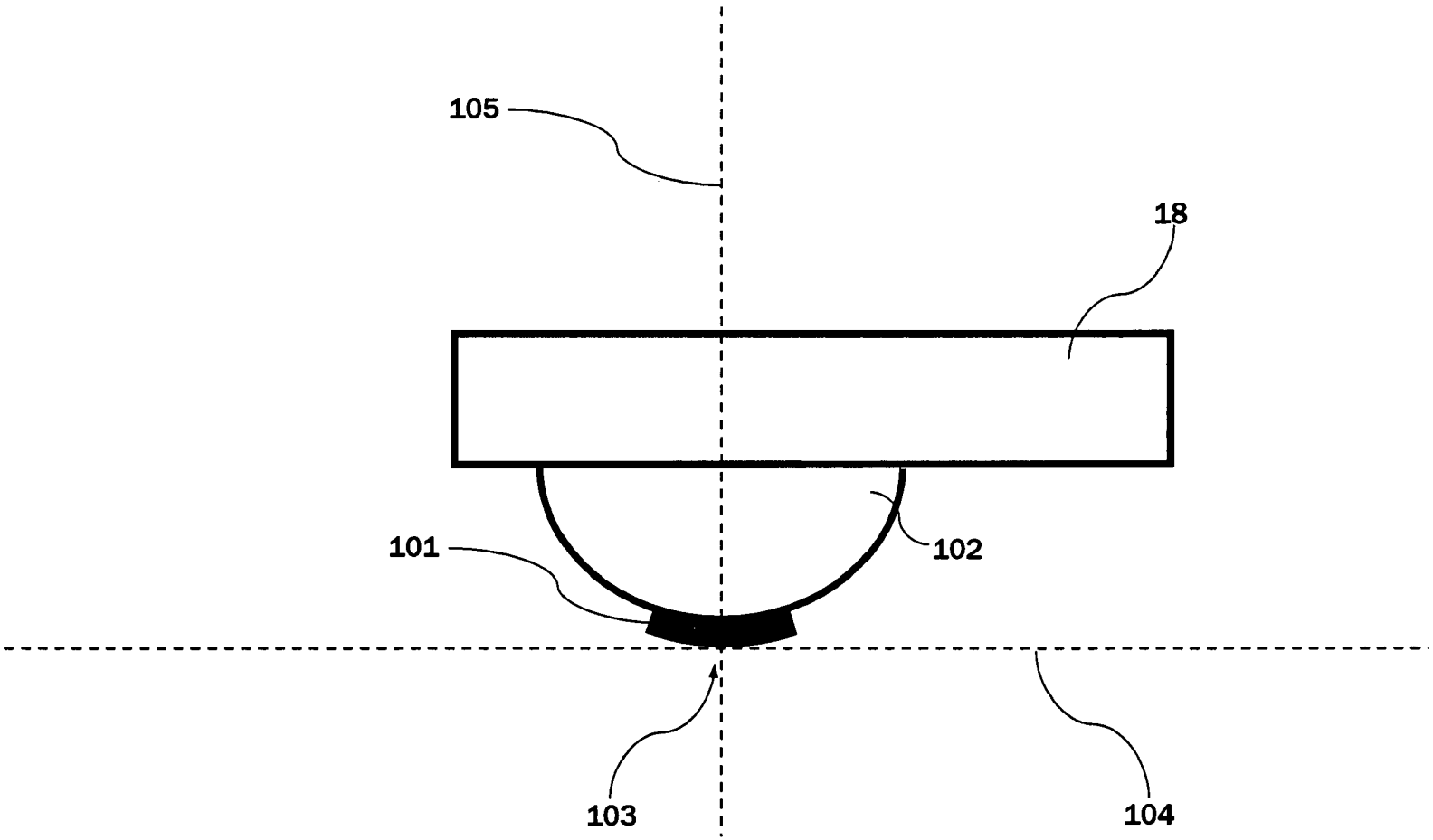
FIG. 4 is a schematic diagram of the print head showing more particularly the geometry of the location with respect to the glaze on which the print line is located.

FIG. 4 is a magnified, cross-sectional view of a print head 18. In FIG. 4 the heating element 101 illustrated is shown as curved to conform to the glaze 102 geometry, although this is only for the purpose of illustration, and the heating elements may be planar or curved. A line 103, that extends perpendicular to the plane of the page, joins the centers of the heating elements, and plane 104 is tangent to the surface of the print line at line 103. Plane 105 is perpendicular to plane 104 and passes through line 103.

Figure 5:
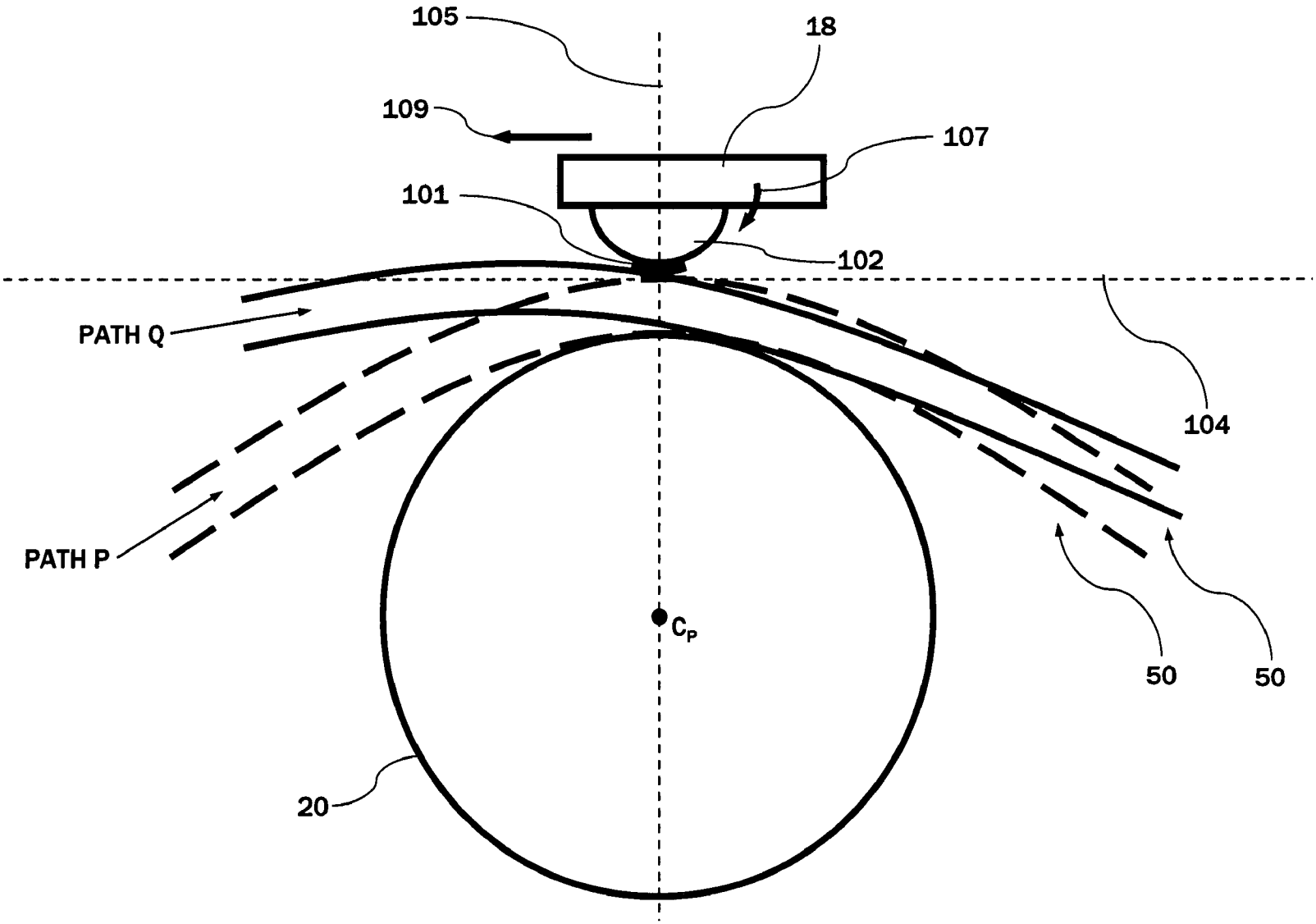
FIG. 5 is a schematic diagram of an imaging material contacted on one surface by a thermal print head and wrapped substantially symmetrically or unsymmetrically around a platen in contact with the opposing surface, illustrating how the wrap of the imaging material around the platen affects the print head alignment.

FIG. 5 shows imaging member 50, wrapped around platen 20, in contact with thermal print head assembly 18. The print line is aligned such that plane 105 that is perpendicular to the print line surface and passes through centerline 103 (FIG. 4) also passes through the rotation axis Cp of the platen roller 20. This alignment of the print line with respect to the platen is referred to throughout the application as "dead center". In this position, plane 104 that is tangent to the print line surface at centerline 103 is parallel to a plane tangent to the platen roller surface and perpendicular to plane 105. As described above, the thermal contact between the print line and imaging member 50 must be optimized to ensure efficient imaging. This will be the case when imaging member 50 is substantially tangent to the surface of the print line at the centerline 103, i.e., when imaging member 50 is in contact with line 103 and substantially parallel to plane 104 at that line of contact. FIG. 5 shows two paths of travel for the imaging member: path P, in which imaging member 50 is substantially symmetrically wrapped around a segment of platen 20, and path Q, in which the wrap of imaging member 50 around platen 20 is not symmetrical. In path P, imaging member 50 is in contact with line 103 and parallel to plane 104 at that line of contact. However, in path Q, although imaging member 50 may be in contact with heating element 101, it is not parallel to plane 104 at that line of contact, and is not in optimal thermal contact with the print line. As can be seen from FIG. 5, dead center print line alignment is only appropriate in path P when the imaging member 50 is substantially symmetrically wrapped around a segment of platen 20 with respect to the plane 105 defined by the platen roller axis Cp and the center line 103. It is also apparent from FIG. 5 that optimal alignment in path Q would be attainable if the print head 18 were rotated slightly in the direction of arrow 107, or else translated in the direction of arrow 109, out of the dead center position.

In thermal printing devices 10 such as that shown in FIG. 1, the driving nip 24 creates tension in the imaging member 50 on one side of the printing nip 26 or 28 but typically no such tension is present in the imaging member 50 on the opposite side of the printing nip. The forces exerted on the imaging member 50 are therefore not symmetrical. The unsymmetrical forces cause the imaging member 50 to wrap unsymmetrically around the platen 20. Therefore, in such thermal printing devices, paths analogous to path Q of FIG. 5 are typically followed by the imaging member, necessitating an alignment of the print line with the platen that is not dead center as defined above, unless steps are taken to make the wrap of the imaging member around the platen more symmetrical.

Figure 6:
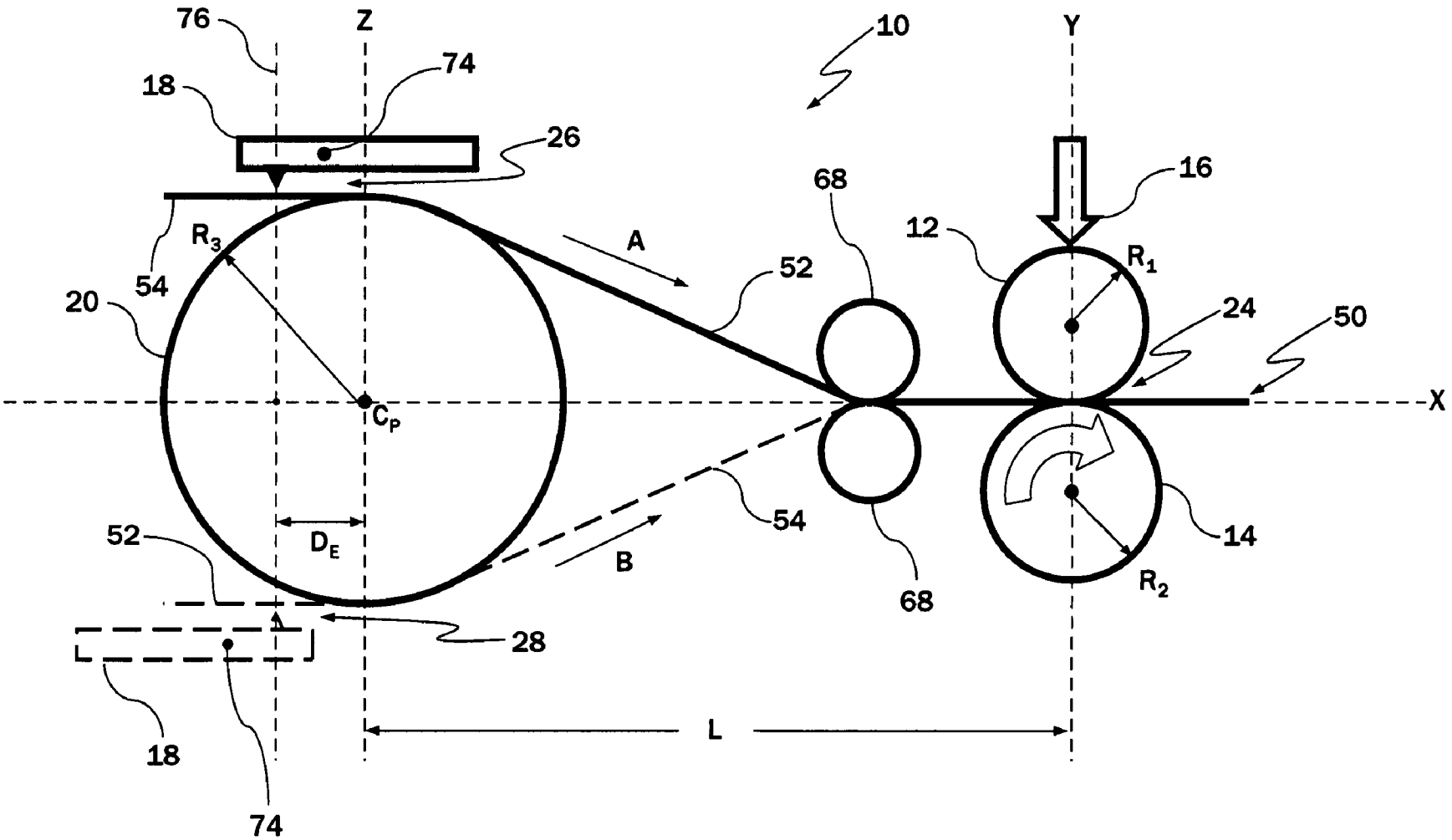
FIG. 6 is a schematic diagram of a thermal printing device with a rotating print head subassembly for rotating the print head subassembly from a first position offset by a first distance from a first perpendicular dead center position with respect to a platen to a second position on the opposite side of the platen that is offset from a second perpendicular dead center position with respect to a platen by the same first distance in accordance with another embodiment of the present invention.

FIG. 6 is a schematic diagram of a thermal printing device 10 with a rotating print head subassembly 18 in which the print line of the print head subassembly 18 is rotatable from a first position offset from a first dead center position with respect to a platen to a second position, in which the print line is offset by the same distance from a second dead center position on the diametrically opposite side of the platen, in accordance with another embodiment of the present invention. The plane that includes the first dead center position, the platen roller axis, and the second dead center position (indicated by Z in FIG. 6) is perpendicular to the plane that includes the platen roller axis and the driving nip 24 (indicated by X in FIG. 6). Both the first and second dead center positions are therefore hereinafter referred to as "perpendicular dead center" positions. The offset of the print line in each printing position from both perpendicular dead center positions compensates for the non-symmetrical wrap of the imaging member 50 about the platen 20. The print head subassembly 18 in each printing position is aligned with plane 76, such that the imaging member 50 is heated when it is substantially tangent to the print line surface at the centerline of the print line.

As shown in FIG. 6, the print line is rotated about an axis that is parallel to, but offset from, the axis of the platen in order to be repositioned from the first to the second printing location. The optimal distance $D_E$, separating the print line rotation axis from the platen axis would be understood by a person skilled in the art to depend on a number of factors including the type of imaging material being used, the bending stiffness of such imaging material, the force applied to the print head, and the tension in the imaging material.

As seen in FIG. 6, the print line in both positions is aligned with plane 76. Also shown in FIG. 6 is axis 74, about which the print head may be rotated with appropriate biasing to ensure good contact with imaging member 50.

Any means may be used to accomplish the repositioning of the print line. Guide rollers 68 are also shown in FIG. 6, but any method described above for maintaining a constant strain of the imaging member surface 54 around the driving roller 14 could be used to complement alignment of the print head subassembly 18. Alternatively, the offset location of the print head subassembly 18 with respect to the perpendicular dead center positions could be used even in the absence of a restriction on the path of the imaging member, so the guide rollers 68 should not be viewed as limiting this embodiment of the present invention.

Figure 7:
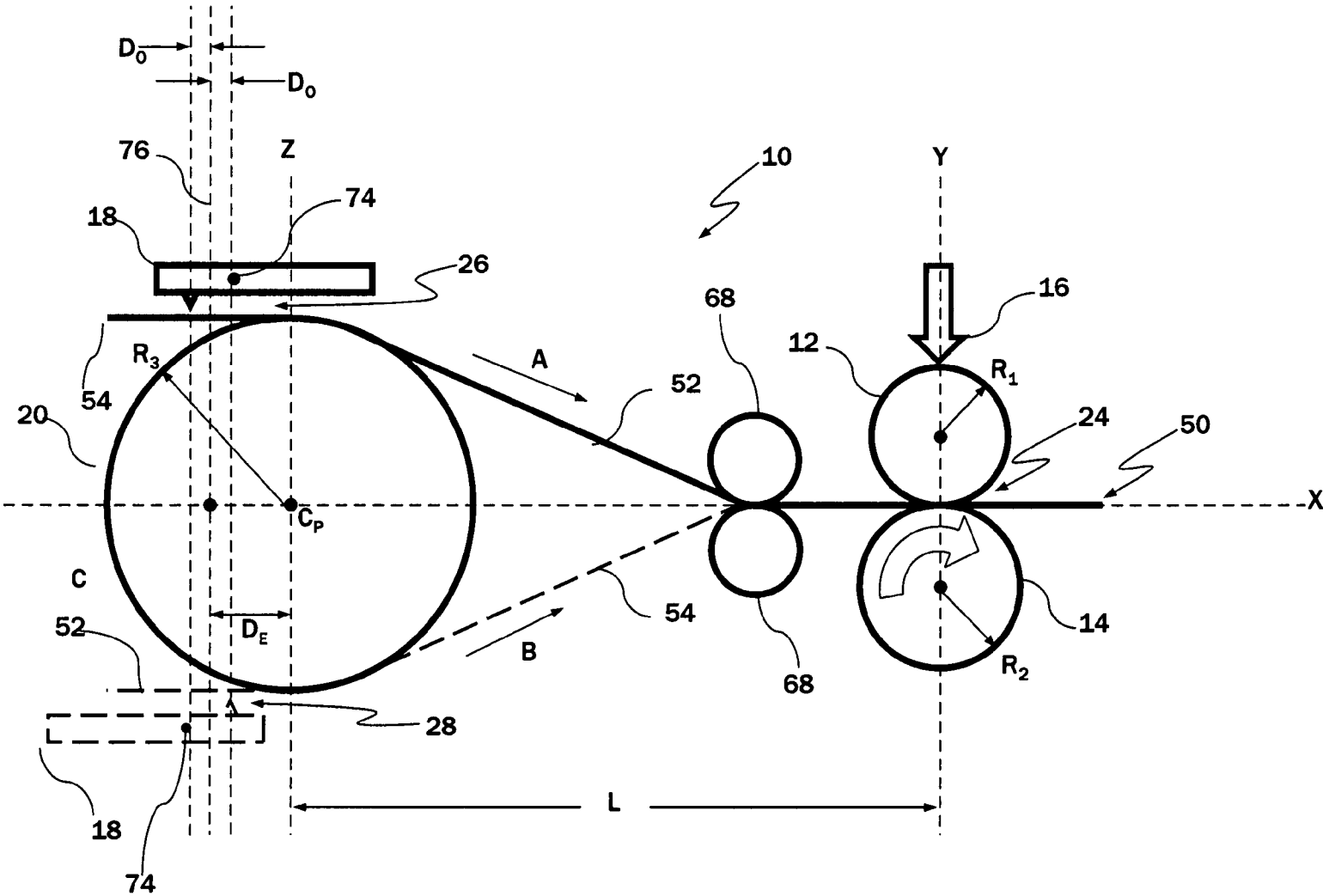
FIG. 7 is a schematic diagram of a thermal printing device with a rotating print head subassembly for rotating the print head subassembly from a first position offset by a first distance from a first perpendicular dead center position with respect to a platen to a second position on the opposite side of the platen that is offset from a second perpendicular dead center position with respect to a platen by a second distance that is not the same as the first distance in accordance with another embodiment of the present invention.

FIG. 7 is a schematic diagram of a thermal printing device 10 with a rotating print head subassembly 18 for rotating the print head subassembly 18 from a first position, offset by a first distance from a first perpendicular dead center position with respect to platen 20, to a second position, offset from a second perpendicular dead center position on the diametrically opposite side of platen 20 by a second distance that is not the same as the first distance, in accordance with another embodiment of the present invention. In FIG. 6, both positions of the print head subassembly 18 are aligned with plane 76. Gravity and contact with other parts of the print head subassembly, however, may cause the optimum locations of the print line to be offset from the plane 76. For example, in an embodiment where the imaging member surface is substantially parallel to the bottom of the printing device 10, as shown in FIG. 7, gravity will have the effect of pulling the imaging member 50 down. Accordingly, when the print head subassembly 18 is positioned on top of the platen 20, the location where the imaging member is substantially horizontal may be closer to the perpendicular dead center position than when the print head subassembly 18 is under the platen 20. As shown in FIG. 7, it may in this situation be desirable to offset the print line by a distance $D_O$ in either direction of the plane 76 depending on which of the two printing positions is considered. This can be achieved by offsetting the print line in the first printing location by $D_O$ from plane 76, since the result will be that the print line will be offset by $D_O$ in the opposite direction in the second printing position after repositioning by rotation through about 180 degrees about an axis. If each optimum position of the print line is predictable, the position of plane 76 is also predictable, and the rotation axis of the print line will be at the intersection of plane 76 and plane X. In this embodiment, therefore, a line on the print head that is parallel to, but offset from, the print line is rotated about an axis that is parallel to, but offset from, the axis of the platen. Accordingly, it is possible to align the print head subassembly optimally for thermal contact with imaging member 50 in both the upper and the lower positions, and thereby reduce the effects that unsymmetrical wrapping of the imaging member 50 around the platen 20 may cause.

Although the thermal printing device of the invention has been described with respect to a preferred embodiment which includes one print head that can be moved to first and second printing positions, as mentioned previously, the printing device can have more than one print head. In another embodiment the printing device includes two thermal print heads positioned to print in the first and second printing positions illustrated in FIGS. 6 and 7.

The embodiments described herein are intended to be illustrative of this invention. As will be recognized by those of ordinary skill in the art, various modifications and changes can be made to these embodiments and such variations and modifications would remain within the spirit and scope of the invention defined in the appended claims and their equivalents. Additional advantages and modifications will readily occur to those of ordinary skill in the art. Therefore, the invention in its broader aspects is not limited to the specific details and representative embodiments shown and described herein.

What is claimed is:

1. A printing device comprising:

a platen for supporting an imaging member during a printing operation; and thermal printing means for printing in a first printing position on a first surface of said imaging member in a first transport path of said imaging member and in a second printing position on a second surface of said imaging member in a second transport path of said imaging member;

said thermal printing means comprising at least one print head subassembly comprising at least one thermal print head for thermal printing on said imaging member;

wherein the positions of the print line of said print head for printing in said first and said second printing positions are each offset from any plane that includes the axis of said platen and any line of contact between said platen and said imaging member.

2. The printing device of claim 1 wherein the position of the print line of said print head is offset from said plane by substantially the same distance in both said first and second printing positions.

3. The printing device of claim 1 wherein the position of the print line of said print head is offset from said plane by a different distance in each of said first and second printing positions.

4. The printing device of claim 1 wherein said printing means comprises two print head subassemblies, each comprising a thermal print head for direct thermal printing on said imaging member, wherein the thermal print head of one of said print head subassembly is positioned for printing on the first surface of said imaging member and the thermal print head of the other said print head subassembly is positioned to print on the second surface of said imaging member.

5. The printing device of claim 1 wherein said printing means comprises one said print head subassembly being configured to be movable independently of said platen for printing on said first surface of said imaging member in said first transport path of said imaging member and for printing on said second surface of said imaging member in said second transport path of said imaging member.

6. A thermal printing method comprising (a) providing a direct thermal imaging member having first and second opposed surfaces;

(b) forming an image in said imaging member with a printing device as defined in claim 1 by the steps:

(b) (1) applying thermal energy to said first surface of said imaging member in an imagewise pattern while said imaging member is traveling in a first transport path, wherein the position of the print line of said print head for printing in said first transport path of said imaging member is offset from any plane that includes the axis of said platen and any line of contact between said platen and said imaging member; and (b) (2) applying thermal energy to said second surface in an imagewise pattern while said imaging member is traveling in a second transport path, wherein the position of the print line of said print head for printing in said second transport path of said imaging member is offset from any plane that includes the axis of said platen and any line of contact between said platen and said imaging member whereby an image is formed in said imaging member.

7. The thermal printing method of claim 6 wherein the position of the print line of said print head is offset from said plane by substantially the same distance when applying thermal energy to both said first and second surfaces of said imaging member.

8. The thermal printing method of claim 6 wherein the position of the print line of said print head is offset from said plane by a different distance when applying thermal energy to both said first and second surfaces of said imaging member.

9. The thermal printing method of claim 6 wherein said printing means comprises two print head subassemblies, each comprising a thermal print head for direct thermal printing on said imaging member, wherein the thermal print head of one said print head subassembly is positioned for printing on the first surface of said imaging member and the thermal print head of the other said print head subassembly is positioned to print on the second surface of said imaging member.

10. The thermal printing method of claim 6 wherein said printing means comprises one said print head subassembly being configured to be movable independently of said platen for printing on said first surface of said imaging member in said first transport path of said imaging member and for printing on said second surface of said imaging member in said second transport path of said imaging member.

* * * * *